United States Patent [19]

Takano

[11] Patent Number: 4,544,907

[45] Date of Patent: Oct. 1, 1985

[54] COMPACT FUSE BLOCK ASSEMBLY

[75] Inventor: Tsunesuke Takano, Tokyo, Japan

[73] Assignee: Kabushiki Kaisha T AN T, Tokyo, Japan

[21] Appl. No.: 655,310

[22] Filed: Sep. 26, 1984

Related U.S. Application Data

[63] Continuation-in-part of Ser. No. 515,961, Jul. 21, 1983, abandoned.

[30] Foreign Application Priority Data

| | | | |
|---|---|---|---|
| Aug. 5, 1982 | [JP] | Japan | 57-119214[U] |
| Aug. 5, 1982 | [JP] | Japan | 57-119215[U] |
| Aug. 5, 1982 | [JP] | Japan | 57-119216[U] |
| Aug. 5, 1982 | [JP] | Japan | 57-119217[U] |
| Jul. 12, 1983 | [JP] | Japan | 58-107909[U] |
| Jul. 12, 1983 | [JP] | Japan | 58-107910[U] |

[51] Int. Cl.[4] ..... H01H 85/24

[52] U.S. Cl. ..... 337/262; 337/264; 337/295

[58] Field of Search ..... 337/198, 262, 264, 265, 337/295

[56] References Cited

U.S. PATENT DOCUMENTS

| | | | |
|---|---|---|---|
| 3,909,767 | 9/1975 | Williamson et al. | 337/198 |
| 4,430,633 | 2/1984 | Ebi | 337/295 |

FOREIGN PATENT DOCUMENTS

| | | |
|---|---|---|
| 56-25439 | 3/1981 | Japan . |
| 56-25440 | 3/1981 | Japan . |
| 56-38957 | 4/1981 | Japan . |
| 56-56155 | 5/1981 | Japan . |
| 58-345 | 1/1983 | Japan . |

*Primary Examiner*—Harold Broome

*Attorney, Agent, or Firm*—Cushman, Darby & Cushman

[57] ABSTRACT

The fuse block assembly has a block which holds an element of substantially inverted U-shape. Co-operating projections and holes or recesses hold the element in position in the block. The ends of the legs of the element project out of the block to act as blade-type electrical terminals. The legs are joined to each other by a fusible portion which acts as the fuse. The plane of the terminals is transverse to the plane of the U. This configuration is stronger than a configuration in which the plane of the terminals lies in the plane of the U. It can be made by bending a flat strip into a U which is less wasteful of materials than cutting out the space between the legs.

18 Claims, 36 Drawing Figures

COMPACT FUSE BLOCK ASSEMBLY

This is a continuation-in-part of application Ser. No. 515,961, filed July 21, 1983, now abandoned.

FIELD OF THE INVENTION

This invention relates to a compact fuse block having a refractable and meltable bridge fuse, and more particularly a plug-in type fuse.

BACKGROUND OF THE INVENTION

The conventional prior art compact fuse comprises a cylindrical enclosure made of glass having metallic caps mounted on each end. A meltable and fusible element which is contained in said enclosure is soldered between the caps. This device has an unfavorable manufacturing cost and does not provide good protection for users. For example, the user will receive an electrical shock when he or she accidentally touches the caps, and the glass enclosure may break when a tool or the like touches the enclosure which is disposed and the fuse then becomes not usable. To overcome such drawbacks, for instance, U.S. Pat. No. 3,909,767 discloses a plug-in type fuse block comprising a pair of blade type terminals between which a fusible element is formed integrally with the terminal material, and a housing having at its one end a gripping member, a pair of through holes for passing the terminals from another end toward an inward direction, and a space to communicate both of the through holes between the holes, for receivably fixing said fuse element. However, this fuse block has drawbacks of production efficiency and lot efficiency of the materials, since a pair of blade type terminals and meltable elements are stamped from a metallic sheet, then the meltable portion is trimmed such as by milling and its link portion is formed. Furthermore, the element easily breaks down or bends unless full attention and care are given, since the meltable element has its both ends, having a small cross sectional area, connecting with the large terminals. Thus, it provides a higher and expensive fuse cost and size in height.

SUMMARY OF THE INVENTION

Primary object of this invention is to provide a plug-in type compact fuse block comprising a block to which a fusible and meltable element portion which is compatible as a fixture terminal, which communicates to a link portion which acts as a fusible and meltable element. A further object of this invention is to provide various configurations of the fusible element having both of its bridge blades with projections, depressions, openings and the like for easy fitting of the terminals.

Other objects of this invention will be easily understood in the preferred embodiments and the accompanying drawings, to overcome the drawbacks in the prior art.

BRIEF DESCRIPTION OF THE ACCOMPANYING DRAWINGS

Figure 3:
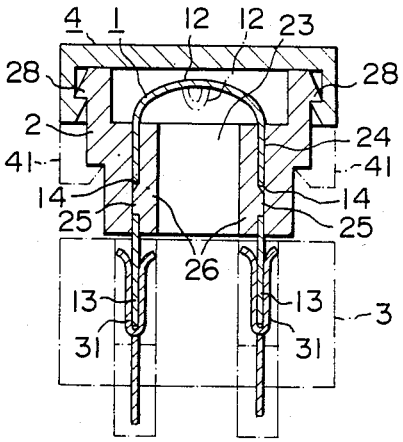
FIG. 3 is a longitudinal cross sectional view of the complete fuse block assembly of the first embodiment.
Figure 2:
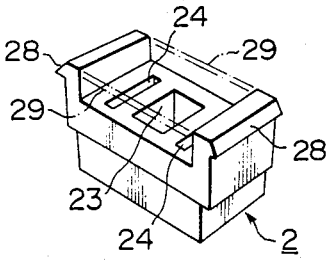
FIG. 2 is a block or holder for the fusible element.
Figure 5:
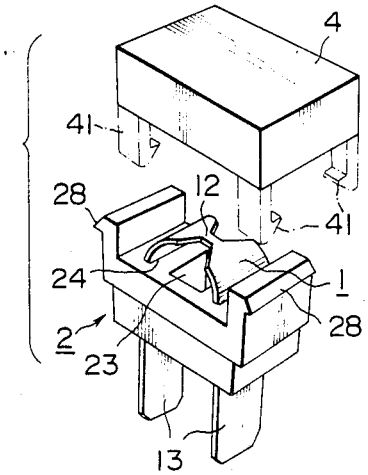
FIG. 5 is a perspective view of the assembly with its lid removed.
Figure 4:
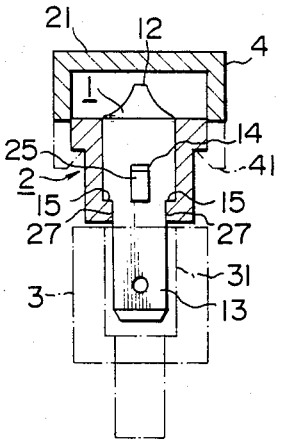
FIG. 4 is a transverse cross sectional view of the assembly of FIG. 3.
Figure 6:
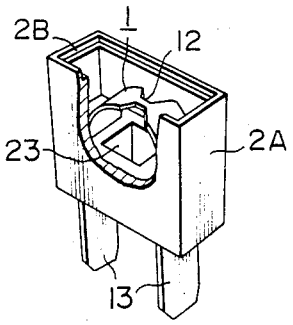
FIG. 6 is a perspective view with a modification of a flattened holder.
Figure 7:
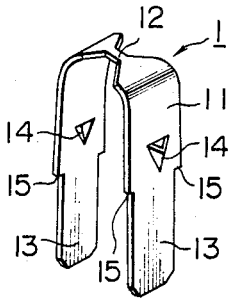
FIG. 7 is a perspective view of a second embodiment of the fusible element.
Figure 8:
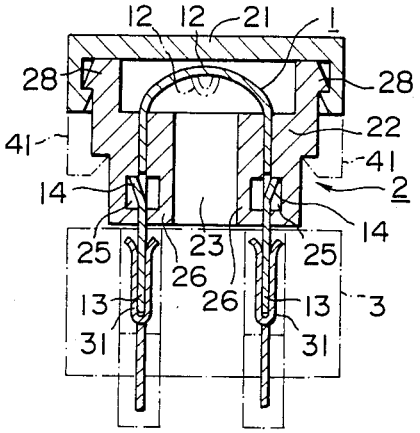
FIG. 8 is a similar view to FIG. 3 for the second embodiment.
Figure 9A:
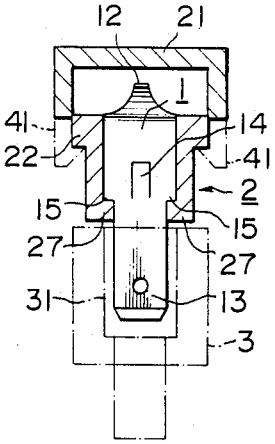
Figure 9B:
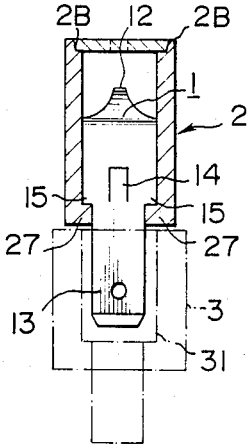
Figure 10A:
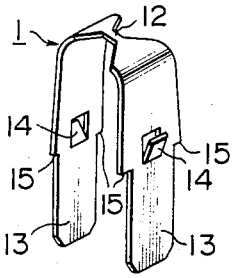
Figure 10B:
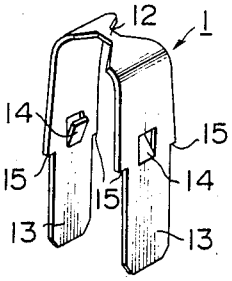
Figure 11:
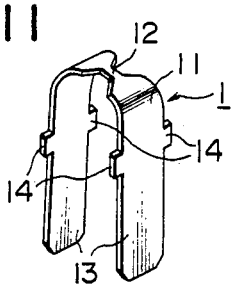
Figure 13:
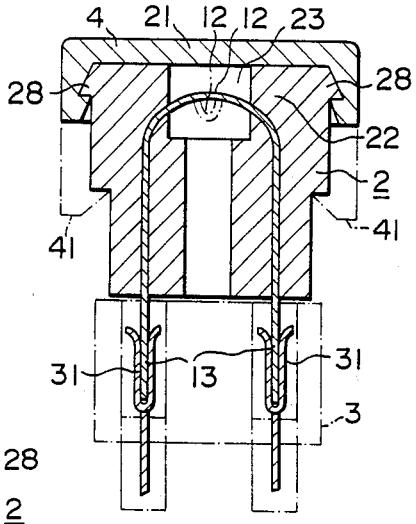
Figure 12:
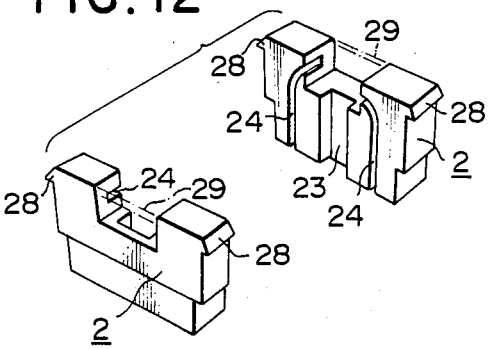
Figure 15:
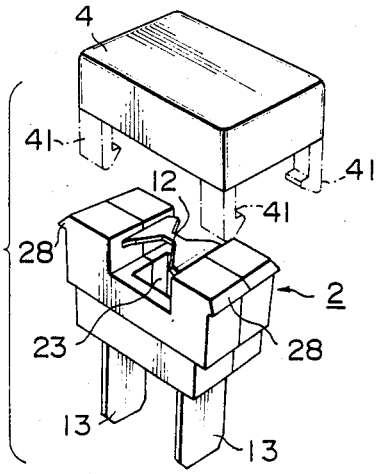
Figure 14A:
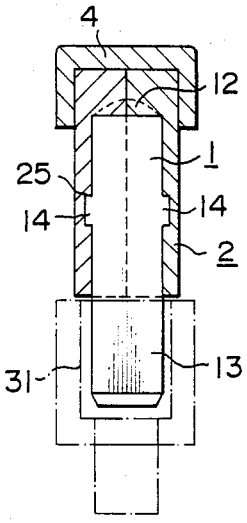
Figure 14B:
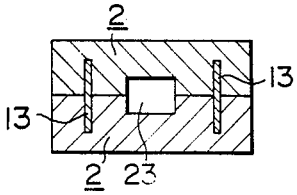
Figure 16A:
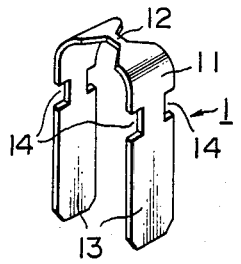
Figure 16B:
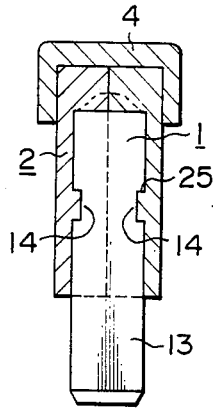
Figure 17:
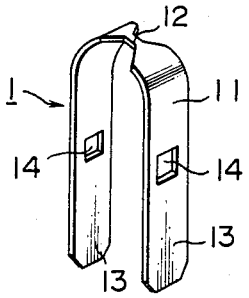
Figure 18:
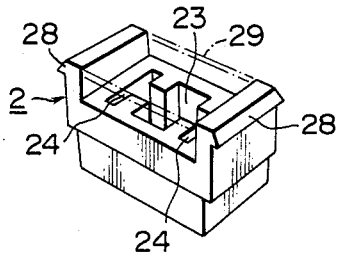
Figure 19:
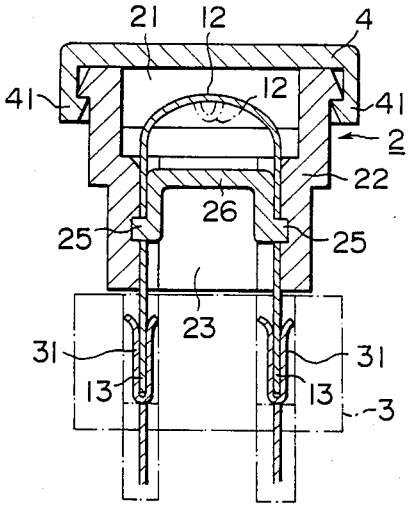
Figure 20A:
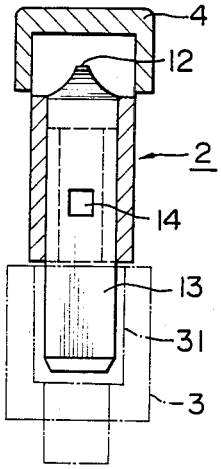
Figure 22:
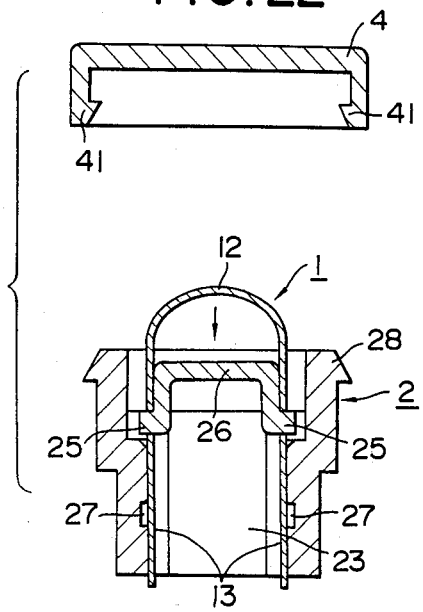
Figure 20B:
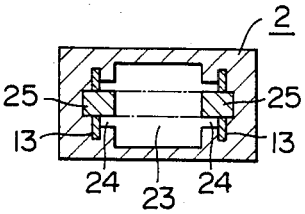
Figure 23A:
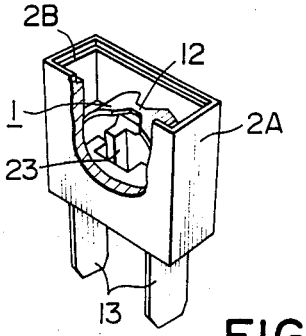
Figure 21:
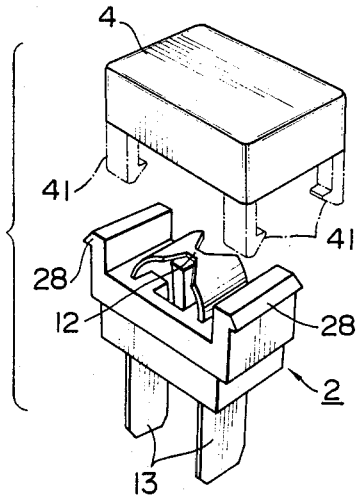
Figure 23B:
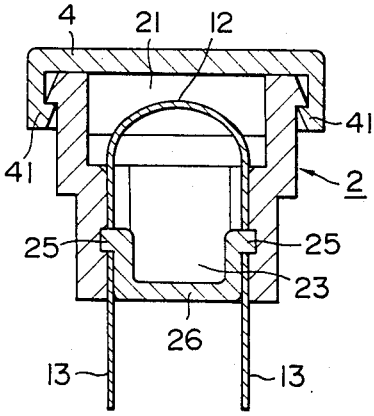
Figure 24A:
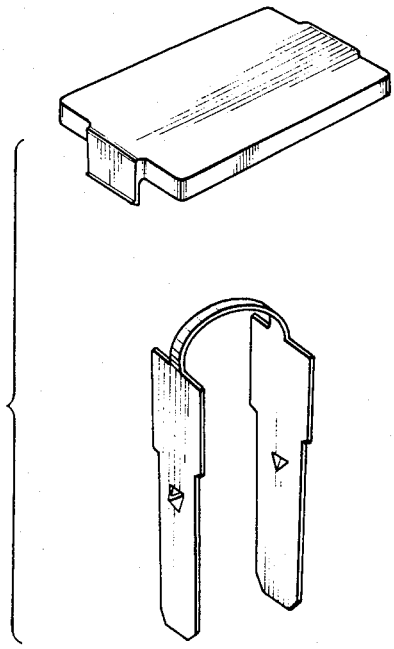
Figure 24B:
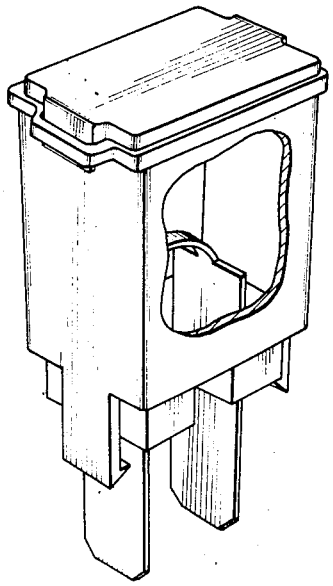
Figure 25:
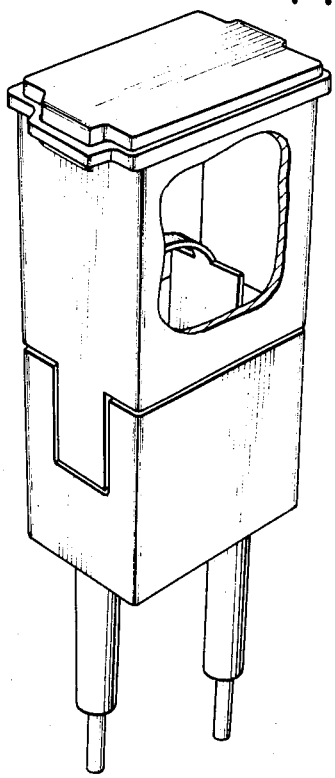
Figure 24C:
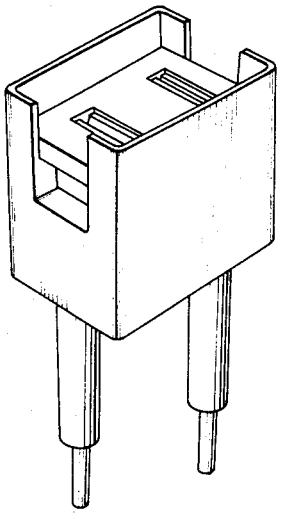
Figure 26:
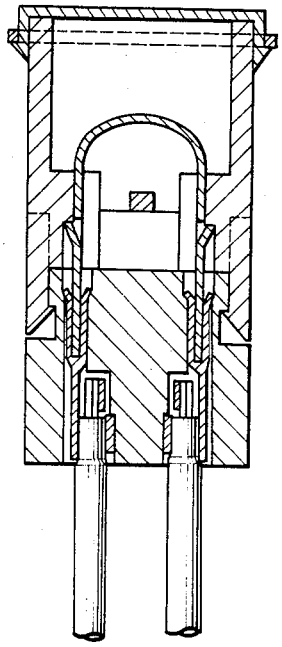
Figure 27:
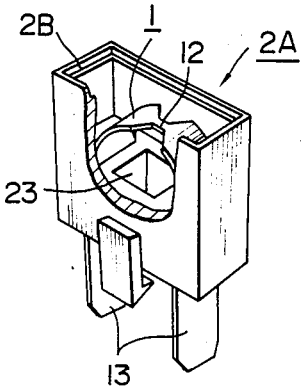
Figure 28:
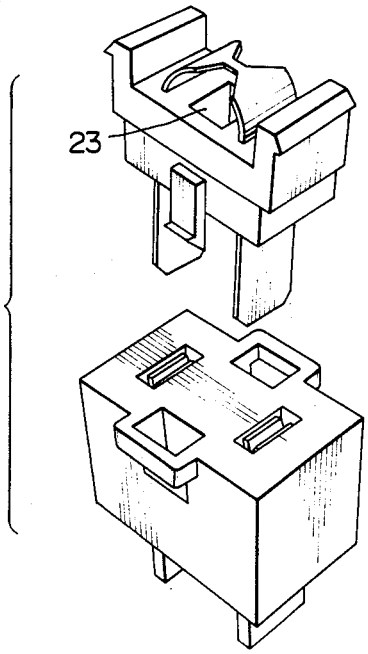

FIGS. 9(*a*) and (*b*) are side cross sectional views similar to FIG. 4 for the second embodiment;

FIGS. 10(*a*) and (*b*) are modifications of the fusible element of the second embodiment;

FIG. 11 is a third embodiment of the fusible element;

FIG. 12 is a similar view of FIG. 2 for the third embodiment;

FIG. 13 is a similar view to FIG. 3 for the third embodiment;

FIGS. 14(*a*) and (*b*) are similar views to FIG. 4 for the third embodiemnt;

FIG. 15 is a similar view to FIG. 5 for the third embodiment;

FIG. 16(*a*) is a view similar to FIG. 11, of a modification of the fusible element;

FIG. 16 (*b*) is a view similar to FIG. 14(*a*), of a cross section of FIG. 16(*a*);

FIG. 17 is a fourth embodiment of the fuse;

FIG. 18 is a similar view to FIG. 2, for the fourth embodiment;

FIG. 19 is a view similar to FIG. 3, showing a cross section for the complete assembly of the fourth embodiment;

FIGS. 20(*a*) and (*b*) but of the fourth embodiment are similar views to FIGS. 14(*a*) and (*b*);

FIG. 21 is a similar view to FIG. 15 but of the fourth embodiment;

FIG. 22 is a cross sectional view of the apparatus of FIG. 21 during assembly;

FIG. 23(*a*) is a similar view to FIG. 6, but showing a further modification of the fourth embodiment;

FIG. 23 (*b*) is a view showing a cross section of a modification of the fourth embodiment;

FIGS. 24(*a*)-(*c*) are views for fifth embodiment, wherein (*a*) shows a fusible element with a top cover plate; FIG. 24 (*b*)shows an assembly of the fuse, the cover plate and a box or holder, and FIG. 24 (*c*) shows an assembly of the structures of FIG. 24 (*a*) and FIG. 24 (*b*) with the holder/receptacle having two connecting round legs;

FIG. 25 is an assembly view of the all the constitutional elements shown in in FIGS. 24(*a*)-(*c*);

FIG. 26 shows an assembly view of the fuse/holder/-receptacle in cross section;

FIG. 27 shows a sixth embodiment of the holder, wherein the fixture leg has an inwardly bent-back construction; and FIG. 28 is a disassembled view showing the fuse/-holder and receptacle of a modification of the sixth embodiment.

PREFERRED EMBODIMENTS OF THE INVENTION

Now, the preferred embodiments of this invention will be hereinafter discussed in detail with reference to the accompanying drawings.

A compact fuse of this invention comprises essentially a fusible element 1 and a holder 2 for holding said fuse element.

Figure 1:
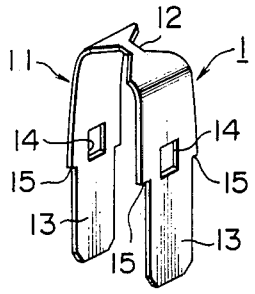
FIG. 1 is a perspective view of the fusible element of a first embodiment of the present invention.

The fusible element 1 is formed from a electroconductive metal, namely zinc. The element is generally a reversed U-shaped member 11 of which upper portion has reduced portions 12 to form a link 12 with a width of 0.8–1.2 mm. This link is used as a fusible piece and is shaped in its thickness to 0.05–0.1 mm by milling operation, so as to provide a nominal current of for example 5 Amp. Extending downwards are fusible terminals 13,13 which are symmetrically formed, as shown in FIG. 1. Provided slightly above said terminals are openings or depressions for engagement 14,14.

The holder 2 to hold the fusible element 1 in U-shape, is formed from insulated refractory synthetic resin, such as phenol resin, strengthened nylon mixed with glass fibers and it comprises a mounting portion 22 having a through window 21 to inspect and see the link 12 of the fusible element 1 from the upper side to downward, a heat discharging through opening or depression 23 at a center of the mount 22 and a plurality of through openings 24, 24 which are flattened for receivably sandwiching the terminals 13,13 of the fusible element 1, and engaging projections 25,25 to rest into the engagement means 14,14 which are openings or depressions provided in the upper side of the terminals 13,13 for tight securement, as shown in FIG. 3.

Hence, an insertion of the fuse element 1 from its terminals 13,13 into the receiving openings 24,24 of the holder 2 from the upper side causes the projections 25,25 to fit in the openings 14,14 with an aid of a resiliency of the legs 26,26 to provide a docking-lock, as shown in FIG. 5.

To this end, an upper movement of the fuse element 1 relative to the holder 2 and the downward movement thereto are blocked correctly by an engagement of the projections 25 and the openings 14, and the steps 15,15 and the walls 27 of the holder 2, respectively, and a horizontal movement of the element 1 is blocked by the peripheries of the openings 24,24.

This fuse block assembly is usable to mount to female receptacles 31,31 which are provided in the fuse box 3 provided in vehicles which have the terminals 13,13, as shown in FIG. 3.

The link 12 can be formed to have a suspension type downward curve as shown in dotted lines, so as to lengthen the link. A cover plate 4 made of a transparent material is mounted onto the hooks 28,28 of the holder 2 as shown in FIGS. 3 and 4, to prevent diffusion of the molten metal when the fuse melts for ambient protection. For further securement of the cover, the cover 4 is provided with a plurality of hooked legs 41,41 for securing it to the holder 2.

The user can easily check through the windows 21 the fused or unfused state of the link 12 even when the assembly is connected to the fuse box 3, and also check from a side when he or she pulls out the assembly from the fuse box. When the assembly is not used, a transparent thin wall 29 or the similar provision is provided in a lengthwise direction of the holder 2, as shown by a chain line in FIG. 2.

This embodiment can also be used with a flattened holder 2A in a box shape as the holder 2 as shown in FIG. 6 with a transparent plate fixed in the upper steps 2B. This will reduce remarkably the total space occupied when several of the assemblies are provided side-by-side.

The fuse can be easily pulled out from the fuse box 3 by pulling out the holder 2,2A.

The second embodiment of this invention provides a modified fuse as shown in FIGS. 7–10, wherein the projections 14,14 on the fuse legs are provided instead of the openings 14,14, and elements which have similar functions to those of the first embodiment, but different configurations are given similar numerals.

As shown in FIGS. 10(*a*) and (*b*), the engagement means are tabs which are bent inwardly or outwardly of the legs of the fuse, for secure fit. Now the third embodiment of this invention will be discussed with reference to FIGS. 11–16, wherein the legs of the fuse have at their sides projections 14,14 for secure fit, and the holder, which is formed by two halves, has at its upper portion a depression to dispose the link of the fuse and slits to receive the upper portions of the terminal legs.

The fuse legs can also have depressions or notches as shown in FIG. 16(*a*)

The fourth embodiment of this invention is shown in FIGS. 17–23, wherein the engaging piece 25 is a rail or I-beam shape in general for secure fit. Summarizing the above features, the specific arrangement designs of the fuse legs with specific engagement means in openings, depressions, and tabs and the holders in specific configurations with steps, hook walls, and in split into halves, so that secure fitting of the fuse with the holder or block and also with the fuse box with an aid of the female receptacles are provided. With such designs and arrangements, the compactness of the fuse-holder assembly is realized.

Now, two further embodiments will be further discussed with reference to the accompanying drawings.

The fifth embodiment is shown in FIGS. 24–26, wherein the fuse element has a link as shown in FIG. 24(*a*) which is thinner than as a whole the comparable element of the first to fourth embodiments and the reduced portion is not provided. The fuse further has an upper cover plate thereabove for closing an outside box for containing the fuse as shown in FIG. 24(*b*). The box has two leg fixtures at its side walls at the bottom continuous therebelow for secure fit with the holder/receptacle having corresponding receiving notches, as shown in FIG. 24(*c*). The receptacle box has two further connectors with a generally round bar configuration therebelow for electrical connection to the power source. The whole assembled state is shown in FIG. 25.

FIG. 26 shows the cross section of the assembly. Its manner of the assembly is almost similar to the first to fourth embodiments. One touch insertion will complete the assembly quite easily.

FIG. 27 shows the sixth embodiment, wherein the secure legs of the walls of the holder, but the legs may not be continuous to the wall and those can be separate pieces which can be soldered or attached any other means.

FIG. 28 shows a modification of the legs which have outwardly bent-backs and the holder/receptacle box has those corresponding openings for receiving those legs therein.

In FIGS. 24 through 28, a number of reference numerals are omitted, as the similar elements are easily understood by those normally skilled in the art.

According to the above design and arrangement of each embodiment and modification of this invention, a quite easy assembling or attaching of the fuse to the holder/block and then to the fuse box or receptacle can be conducted by unskilled persons, in a quite safe manner, and the remarkably compact size assembly can be provided. Therefore, those can be juxtaposed in numerous fuse box or power source, even in a mobile home.

It will now be clear that there has been provided herein an assembly which accomplishes the objects heretofore set forth. While the invention has been disclosed in a preferred form, it is to be understood that the specific preferred embodiments thereof as described and illustrated herein are not to be considered in a limiting sense as there may well be other forms or modifications of the preferred embodiments which should also be construed as coming within the scope of the appending claims.

In this sense, the opening or openings of the blade fuse, or depression or depressions and other elements can be any form convenient, such as round, triangular, ellipsoidal, oblong, rectangular, square and other polygonal shapes. A number of the constitutional elements are also variable as far as the same objects and effects and utility can be realized.

I claim:

1. A fuse block assembly, comprising:

an electrically insulating fuse block, and an electrically conductive fuse element receivable in the fuse block;

said fuse element made of zinc and being substantially inverted U-shaped, having two legs, with each said leg comprising a blade-type terminal for electrical contact;

said terminals having ends which extend out of the block through respective slots formed through a wall thereof, and said legs each having step means extending transversally of said legs constructed and arranged such that when said fuse element is in a position of use received in the block said step means engage an internal face of said wall internally of said block;

the terminals being in two at least generally parallel planes which are at least generally transverse to a plane common to the legs of the U,;

the terminals being connected to each other through a fusible portion of the fuse element which fusible portion is of reduced cross-section and the melting of which in use constitutes blowing of the fuse; and said fuse element and said block being provided with cooperating engagement means which act to hold them together in said position of use.

2. A fuse block assembly according to claim 1, in which:

the fuse block has means defining holes through it, through which holes the legs of the fuse element extend when said fuse element is in its position of use, the engagement means of the fuse element being provided on the legs of the fuse element above the terminals and the engagement means of the block being provided in the holes.

3. A fuse block assembly according to claim 2 in which:

the engagement means of the fuse element are depressions and the engagement means of the block are projections.

4. A fuse block assembly according to claim 2, in which:

the engagement means of the fuse element are openings and the engagement means of the block are projections.

5. A fuse block assembly according to claim 2, in which:

the engagement means of the fuse element are projections and the engagement means of the block are recesses.

6. A fuse block according to claim 1, in which:

the fuse block comprises at least two parts which are assembleable around the fuse element to receive it in its position of use, these parts having channels to receive the edges of a portion of the legs of the fuse element above the terminals, the engagement means of the fuse element being provided on said edges and the engagement means of the block being provided in said channels.

7. A fuse block assembly according to claim 6, in which:

the engagement means of the fuse element are recesses and the engagement means of the block are projections.

8. A fuse block assembly according to claim 6, in which:

the engagement means of the fuse element are projections and the engagement means of the block are recesses.

9. A fuse block assembly according to claim 1, in which:

at least a portion of the legs of the fuse element above the terminals are received within the block when the fuse element is in its position of use, the engagement means of the fuse element comprising holes in said portions and the engagement means of the block comprising an engagement piece in strip or rod form which extends in use between the legs of the fuse element with the ends of the piece passing through the said holes in the fuse element and being received in recesses in the block.

10. A fuse block assembly according to claim 9, in which:

the engagement piece has end portions which extend away from each other and are connected to intermediate portions which extend parallel to each other, the intermediate portions being connected in turn to a central portion extending substantially parallel to the end portions.

11. A fuse block assembly according to claim 1, in which:

the fuse block comprises a mount and a lid, the fuse element being mounted in the mount with the fusible portion exposed when it is in its position of use, the lid being fittable to the mount to cover the fusible portion of the element and having a means providing a window so that the fusible portion of the element can be seen through the lid when the lid is fitted to the mount.

12. A fuse block assembly according to claim 1, in which:

the block has an opening immediately below the position of the fusible portion when the fuse element is in its position of use.

13. A fuse block assembly according to claim 1, in which:

the block has a depression located immediately below the position of the fusible portion when the fuse element is in its position of use.

14. A fuse block assembly according to claim 1, in which:

the fusible portion of the fuse element has a reduced width.

15. A fuse block assembly according to claim 1, in which:

the fusible portion of the fuse element has a reduced thickness.

16. A fuse block assembly according to claim 1, in which:

the fusible portion of the fuse element is in the shape of an upright U substantially smaller than the inverted U of the fuse element as a whole, to give the fusible portion increased length.

17. A fuse block assembly according to claim 1, which further comprises:

an adaptor portion having socket terminals suitable to receive and make electrical contact with the terminals of the fuse element, and projecting terminals electrically connected to the socket terminals.

18. A fuse block assembly according to claim 17, in which:

the fuse block has clips extending therefrom for connection to the adaptor portion.

* * * * *